US006972302B2

(12) United States Patent
Baker et al.

(10) Patent No.: US 6,972,302 B2
(45) Date of Patent: Dec. 6, 2005

(54) CASTING SAND CORES AND EXPANSION CONTROL METHODS THEREFOR

(75) Inventors: Stephen G. Baker, Spencer, IN (US); Joshua M. Werling, Fishers, IN (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 83 days.

(21) Appl. No.: 10/653,363

(22) Filed: Sep. 2, 2003

(65) Prior Publication Data

US 2004/0044097 A1 Mar. 4, 2004

Related U.S. Application Data

(63) Continuation-in-part of application No. 09/847,182, filed on May 1, 2001, now abandoned.

(51) Int. Cl.[7] ..... B22C 1/00
(52) U.S. Cl. ..... 523/139; 524/431; 524/430
(58) Field of Search ..... 523/139; 524/431, 524/430

(56) References Cited

U.S. PATENT DOCUMENTS 4,735,973 A * 4/1988 Brander ..... 523/139
5,911,269 A * 6/1999 Brander et al. ..... 164/523

* cited by examiner

*Primary Examiner*—Katarzyna Wyrozebski
(74) *Attorney, Agent, or Firm*—Dennis Kelly Sullivan; Susan L. Lukasik; Jeffrey P. Calfa

(57) ABSTRACT

Thermal expansion of sand cores and the formation of vein defects during metal casting operations can be substantially eliminated, with substantially reduced costs, by using an anti-veining material comprising less than about 4% by weight of a lithia-containing material, and at least about 1% by weight of ferric oxide ($Fe_2O_3$), said anti-veining material preferably comprising 2.5% $Li_2O$, 10–25% of $TiO_2$, 15–25% $Al_2O_3$, 10–25% of $Fe_3O_4$, and 60–70% of $SiO_2$ mixed with about 1% by weight of $Fe_2O_3$, preferably red iron oxide.

15 Claims, No Drawings

CASTING SAND CORES AND EXPANSION CONTROL METHODS THEREFOR

This application is a continuation-in-part of U.S. patent application Ser. No. 09/847,182, filed May 1, 2001 now abandoned.

FIELD OF THE INVENTION

This invention relates to sand cores for use in producing metal castings, and more particularly to sand cores with controlled thermal expansion and to methods of controlling the thermal expansion of sand cores during metal casting operations.

BACKGROUND OF THE INVENTION

Sand cores are used to form the internal cavities of a finished casting. When sand cores are placed in a mold and molten metal is introduced into the mold, a rapid thermal expansion of the sand in the sand cores takes place. As a result of the rapid thermal expansion of the sand in the sand core, the sand core cracks, and the molten metal runs into the cracks in the core, creating a fin projecting from the casting surface (in foundry terms, a "vein") as the molten metal solidifies. These veining defects, caused by uncontrolled core sand thermal expansion, are most often controlled by anti-veining or expansion control agents, which are mixed uniformly with the sand and core sand binders prior to the formation of the sand cores themselves. Anti-veining or expansion control agents change the thermal coefficient of expansion of the sand core to control its cracking and the formation of veins.

For years, iron oxides were used in foundries to improve sand cores and the qualities of castings. Iron oxides proved to be advantageous in sand cores by reducing the formation of thermal expansion defects such as veining. Iron oxides in use include red iron oxide ($Fe_2O_3$), also known as hematite, black iron oxide ($Fe_3O_4$), known as magnetite, and yellow ochre. The most common methods of employing such iron oxides are by addition of approximately 1% to 3% by weight to the core sand during mixing. The mechanism by which iron oxides improve the surface finish is not known. One theory is that the iron oxides increase the plasticity of the sand core during casting by formation of sand grain interfaces which deform, or give, without fracturing, thereby preventing cracks in the core which can form veins in the casting.

U.S. Pat. No. 4,735,973 discloses an additive for the foundry sands used to produce cores and molds which improves the quality of the castings by reducing thermal expansion and gas defects, thereby reducing the veins formed in a casting. The disclosed additive comprises a composition containing from about 15% to about 95% titanium dioxide ($TiO_2$), including a preferable additive comprising about 2% to about 38% silicon dioxide ($SiO_2$), about 5% to about 40% ferric oxide ($Fe_2O_3$), about 15% to about 95% titanium dioxide ($TiO_2$), and about 2% to about 45% aluminum oxide ($Al_2O_3$). The resulting sand cores are described as comprising about 80% to about 98% of core sand aggregates selected from a group consisting of silica sand, zircon sand, olivine sand, chromite sand, lake sand, bank sand, fused silica, and mixtures thereof, about 0.5% to about 10% of a core sand binder, and about 0.5% to about 5% of an additive composition containing from about 15% to about 95% titanium dioxide ($TiO_2$). The use of such additives in sand cores is described as reducing the casting defects associated with the use of plastic bonded and other core binder systems, increasing the strength of the resulting bonded core sand, and allowing a reduction in the amount of plastic binder required.

U.S. Pat. No. 5,911,269 discloses a method of making silica sand cores utilizing lithium-containing materials that provide a source of lithia ($Li_2O$) to improve the quality of castings by reducing sand core thermal expansion and the veins resulting therefrom in metal castings. The disclosed method of making sand cores comprises the steps of preparing an aggregate of sand core and a resin binder, and mixing into the aggregate a lithium-containing additive selected from a group consisting of .α.-spodumene, amblygonite, montebrasite, petalite, lepidolite, zinnwaldite, eucryptite and lithium carbonate, in the amount to provide from about 0.001% to about 2% of lithia. The use of such a method and lithia-containing additives is described as reducing the casting defects associated with thermal expansion of silica, including the formation of veins in the cavity and improving the surface finish of the castings.

VEINSEAL® 14000 is an effective, but expensive, anti-veining agent that is sold by IGC Technologies, Inc. of Milwaukee, Wis. VEINSEAL® 14000 costs about $650 per ton, and in the operation of a modern foundry, producing tens of thousands of internal combustion engine blocks and cylinder heads per year, the use of VEINSEAL® 14000 anti-veining agent at the minimum effective concentration of 5% by weight of the sand cores, which is the minimum effective concentration, can cost as much as $700,000 per year. VEINSEAL® 14000 comprises 60–70% by weight of $Si_2$, 10–20% by weight of $Fe_3O_4$, 15–25% by weight of $Al_2O_3$, 10–25% by weight of $TiO_2$ and 2–5% by weight of $Li_2O$.

SUMMARY OF THE INVENTION

The invention provides methods of reducing or eliminating the thermal expansion of sand cores and the formation of vein defects during metal casting operations, with substantially reduced costs, by using an anti-veining material comprising less than about 4% by weight of a lithia-containing material, and at least about 1% by weight of ferric oxide ($Fe_2O_3$), said anti-veining material preferably comprising about 1% to about 3.5% by weight of a lithia-containing material and about 1% by weight of red iron oxide ($Fe_2O_3$). In another preferred method of the invention for reducing and substantially eliminating the thermal expansion of sand cores and the formation of vein defects, about 2% by weight of VEINSEAL® 14000, a lithia-containing anti-veining agent, and about 1.5% of Black Rouge iron oxide ($Fe_2O_3$) were used to form sand cores with a phenolic urethane cold box resin binder and core sand. Black Rouge iron oxide is available from the Prince Manufacturing Company in Quincy, Ill.

In methods of the invention, a sand core for casting is manufactured by providing a uniform mixture of a quantity of core sand, an effective amount of core sand binder, and an anti-veining material comprising less than about 4% of a lithia-containing material and at least about 1% by weight of ferric oxide, and preferably about 1.0% to about 3.5% by weight of VEINSEAL® 14000 anti-veining material, and about 1% of Black Rouge iron oxide ($Fe_2O_3$), and forming a sand core from the resulting mixture. One preferred casting core is comprised of a mixture including about 2.5% to about 3.5% by weight of a lithia-containing material, preferably VEINSEAL® 14000 anti-veining material, about 1% by weight of red iron oxide ($Fe_2O_3$), and the balance of silica sand with an effective amount of binder. Another preferred sand core for casting is comprised of a mixture including about 1% by weight of a lithia-containing material, about 1% by weight of ferric oxide ($Fe_2O_3$), and the balance of lake sand with an effective amount of binder. Another sand core can be comprised of a mixture including about 2% VEINSEAL® 14000 anti-veining material, about 1.5% Black Rouge iron oxide ($Fe_2O_3$) and the balance core sand with an effective amount of binder. The lithia-containing materials included in this invention preferably comprise the VEINSEAL® 14000 product and, it is believed, other such lithia-containing materials as are described in U.S. Pat. No. 5,911,269.

The invention reduces the cost of the use of expensive anti-veining additives by about 25% to 70%, saving in high volume casting operations from about $175,000 per year to about $500,000 per year.

DETAILED DESCRIPTION OF THE INVENTION

The invention attacks the problem of the formation of veins in metal castings that are caused by the thermal expansion of the sand cores used in the castings. As indicated above, when exposed to the high temperatures of the molten metal within a casting mold, sand cores can rapidly expand and crack and, as a result, molten metal can run into the sand core cracks, creating projecting veins on the resulting casting. As a result of the invention, such defects are substantially eliminated by the addition of an anti-veining material comprising selected amounts of a lithia-containing material, and ferric oxide ($Fe_2O_3$), also known as hematite, which are uniformly mixed with the core sand and binder that form the sand cores of the casting. The invention may include any conventional foundry core sand, such as silica sand (e.g., Badger sand and Manley sand), zircon sand, olivine sand, chromite sand, lake sand, bank sand, fused silica, and mixtures thereof. In manufacturing sand cores, such sand particles are generally combined with an effective amount of a core sand binder, for example, about 0.5% to about 10% by weight of the sand, and any of numerous core binder systems may be used, such as phenolic hotbox, phenolic urethane coldbox, furan, sodium silicate including esters and carbon dioxide systems, polyester binders, acrylic binders, alkaline binders, epoxy binders, and furan warmbox systems. The above core sand binders and the amounts that are effective in use are well known in the art, and it is unnecessary herein to list the effective amounts and describe the manner by which an effective amount of binder is determined for use in the manufacture of sand cores. Where we refer to percentages by weight, we mean percentage by weight of the core sand.

To be effective in reducing veining defects, at least about 5% by weight of a lithia-containing material such as the VEINSEAL® 14000 product, must be added to the core sand from which a casting core is formed. With about 4% or less of the VEINSEAL® 14000 product and such lithia-containing materials added to the core sand, the resulting sand cores crack during metal casting operations, creating unwanted veins in the casting, which must be removed by subsequent finishing operations.

In the invention, thermal expansion of sand cores and unwanted veins in the metal casting formed thereby are substantially eliminated with the use of less than 4% by weight of lithia-containing anti-veining agents, such as the VEINSEAL® 14000 product, combined with the use of an effective amount of ferric oxide ($Fe_2O_3$), at least about 1% by weight. Preferably about 1% by weight of red iron oxide ($Fe_2O_3$), also known as hematite, is combined with from about 1% to about 3.5% by weight of a lithia-containing material, and the resulting anti-veining material is uniformly mixed with the core sand binder mixture. The lithia-containing material used in the invention is preferably the VEINSEAL® 14000 product, and other such anti-veining agents as are described in U.S. Pat. No. 5,911,269, the disclosure of which is incorporated herein by reference. In other methods of the invention, the use of VEINSEAL® 14000 material in an amount of about 2% by weight is combined with about 1.5% by weight of Black Rouge iron oxide ($Fe_2O_3$) and uniformly mixed into core sand and an effective amount of binder to provide sand cores that economically produce veinless castings.

The following examples demonstrate the invention.

EXAMPLE 1

A mixture including Badger (55) core sand, 1.1% by weight of phenolic urethane coldbox resin, and 4% by weight of VEINSEAL® 14000, a lithia-containing material which may include $SiO_2$, $Fe_3O_4$, $Al_2O_3$, and $TiO_2$, was formed into a cylindrical rod having a diameter of several inches and a height of several inches. A casting was made with the cylindrical rod sand core, and the resulting casting included a cylindrical cavity whose interior cylindrical surface was characterized by veins extending inwardly from the interior walls and significant porosity. The veins that were formed constituted defects requiring a subsequent finishing operation for their removal.

EXAMPLE 2

A quantity of Badger (55) sand was combined with 1.2% by weight of a phenolic urethane coldbox resin binder, 3% by weight of the VEINSEAL® 14000 product used in Example 1, and 1% by weight of $Fe_2O_3$. A cylindrical sand core was formed with the same dimensions as in Example 1. A casting made with the sand core resulted in a cylindrical cavity having walls free of veins.

EXAMPLE 3

A mixture was formed, including Badger (55) core sand, 1.2% by weight of a phenolic urethane coldbox resin, 2.5% by weight of the VEINSEAL® 14000 product used in Examples 1 and 2, and 1% by weight of $Fe_2O_3$. The resulting mixture was formed into a cylindrical rod with the same dimensions as in Examples 1 and 2, which was used to make a casting, and the resulting casting included a cylindrical cavity having walls free of veins.

EXAMPLE 4

A mixture of Manley (50) core sand, 1.25% by weight of phenolic urethane coldbox resin, and 5% by weight of the VEINSEAL® 14000 product used in Examples 1–3, was formed into a cylindrical rod having the same dimensions as in Examples 1–3. A casting was made with the cylindrical rod sand core, and the resulting casting included a cylindrical cavity whose interior cylindrical surface was characterized by veins extending inwardly from the interior walls, which constituted a defect requiring a subsequent finishing operation for their removal.

EXAMPLE 5

A quantity of Manley (50) sand was combined with 1.1% by weight of a phenolic urethane coldbox resin binder, 3% by weight of the VEINSEAL® 14000 product used in Examples 1–4, and 1% by weight of $Fe_2O_3$. A cylindrical sand core was formed with the same dimensions as in Examples 1–4. A casting made with the sand core resulted in a cylindrical cavity having walls free of veins.

EXAMPLE 6

A mixture was formed, including Manley (50) core sand, 1.1% by weight of a phenolic urethane coldbox resin, 2.5% by weight of the VEINSEAL® 14000 product used in Examples 1–5, and 1% by weight of $Fe_2O_3$. The resulting mixture was formed into a cylindrical rod sand core having the same dimensions as in Examples 1–5, which was used to make a casting, and the resulting casting included a cylindrical cavity having walls free of veins.

EXAMPLE 7

A mixture was formed including Technisand® 1L5W core sand, which is a lake sand product of Technisand from Bridgman, Mich., 1.4% by weight of a phenolic urethane cold box resin binder, 2% by weight of the VEINSEAL® 14000 product used in Examples 1–6, and 1.5% by weight of Black Rouge iron oxide ($Fe_2O_3$). The resulting mixture was formed into a cylindrical rod sand core having the same dimensions as in Examples 1–6, which was used to make a casting, and the resulting casting included a cylindrical cavity having walls free of veins.

Thus, sand cores for casting that are free of veining defects can be formed by uniformly mixing together core sand, an effective amount of binder for the core sand, less than 4% by weight of a lithia-containing material, preferably VEINSEAL® 14000 material, and about 1% by weight of $Fe_2O_3$, preferably red iron oxide, and forming a core from the resulting mixture. Sand cores free of veining defects can also be formed using about 2% by weight of VEINSEAL 14000® material and about 1.5% by weight of Black Rouge iron oxide. The methods and sand cores of the invention effect savings of hundreds of thousands of dollars per year in casting internal combustion engine blocks and heads.

The examples demonstrate that the introduction of as little as about 1% ferric oxide, which costs about $180 per ton, can reduce the quantity of lithia-containing anti-veining agent used in sand cores to substantially below 4% by weight (e.g., 2% by weight) and can effectively eliminate thermal expansion of the sand cores and the introduction of veins into the resulting castings, and, it is believed, may reduce the use of core sand binder by up to about 1/10th of 1%. The invention thus permits a cost reduction in the methods of controlling or eliminating sand core casting veins of from about 25% to about 70%, permitting the saving of hundreds of thousands of dollars, with no decrease in the quality of the resulting castings.

Those skilled in the art will recognize that the invention may comprise other sand core compositions and methods of controlling the thermal expansion of sand cores and the veining of castings without departing from the scope of the claims that follow.

We claim:

1. A method of making a sand core for casting, comprising uniformly mixing together a core sand, an effective amount of binder, about 1% to about 3.5% by weight of a lithia-containing material including 2–5% of $Li_2O$, 10–25% of $TiO_2$, 15–25% of $Al_2O_3$, 10–20% of $Fe_3O_4$, and 60–70% of SiO2, and about 1% by weight of $Fe_2O_3$ as a core-forming material, and forming the core-forming material into a sand core.

2. The method of claim 1 wherein the amount of $Fe_2O_3$ comprises about 1% by weight of red iron oxide.

3. The method of claim 2 comprising about 2.5% by weight of the lithia-containing material and wherein the core sand comprises a silica sand.

4. The method of claim 1 comprising equal amounts by weight of the lithia-containing material and $Fe_2O_3$, and wherein the core sand comprises lake sand.

5. The method of claim 1 wherein the core-forming material contains about 1% by weight of a lithia-containing material.

6. The method of claim 1 wherein the step of uniformly mixing comprises 2% by weight of said lithia-containing material.

7. A method of making a sand core for casting, comprising uniformly mixing together a core sand, an effective amount of core sand binder, an anti-veining material comprising less than 4% by weight of a lithia-containing material comprising 2–5% of $Li_2O$, 10–25% of $TiO_2$, 15–25% of $Al_2O_3$, 10–20% of $Fe_3O_4$, and 60–70% of SiO2, and about 1% or more by weight of $Fe_2O_3$ as a core-forming mixture, and thereafter forming the core-forming mixture into a sand core.

8. The method of claim 7 wherein the amount of $Fe_2O_3$ comprises about 1% by weight of red iron oxide.

9. The method of claim 8 wherein the lithia-containing material comprises about 1% by weight and wherein the core sand comprises lake sand.

10. The method of claim 7 wherein the lithia-containing material comprises about 1% to about 2.5% by weight.

11. The method of claim 10 wherein the lithia-containing material comprises about 2.5% by weight, and wherein the core sand comprises a silica sand.

12. The method of claim 7 comprising about 2% by weight of lithia-containing material and about 1.5% by weight of iron oxide ($Fe_2O_3$).

13. The method of claim 7 wherein the lithia-containing materials is selected from a group consisting of .α.-spodumene, amblygonite, montebrasite, petalite, lepidolite, zinnwaldite, eucryptite and lithium carbonate.

14. The method of claim 7 wherein the $Fe_2O_3$ comprises red iron oxide.

15. In a method of making a sand core for casting, comprising uniformly mixing together a core sand, an effective amount of core sand binder and an anti-veining material, and thereafter forming from the resulting mixture a sand core, the improvement wherein the anti-veining material comprises about 1% to about 3.5% by weight of a mixture including 2–5% of $Li_2O$, 10–25% of $TiO_2$, 15–25% of $Al_2O_3$, 10–25% of $Fe_3O_4$, and 60–70% of $SiO_2$, and about 1.5% by weight of red iron oxide ($Fe_2O_3$).

* * * * *